US005503569A

United States Patent [19]

Huss, Jr. et al.

[11] Patent Number: 5,503,569

[45] Date of Patent: Apr. 2, 1996

[54] ELECTRICAL CONNECTOR WITH TWO STAGE LATCH FOR RETAINING CONTACTS

[75] Inventors: John P. Huss, Jr., Harrisburg; George H. Douty, Mifflintown; John M. Landis, Camp Hill, all of Pa.

[73] Assignee: The Whitaker Corporation, Wilmington, Del.

[21] Appl. No.: 133,232

[22] Filed: Oct. 4, 1993

[51] Int. Cl.[6] ..... H01R 13/40

[52] U.S. Cl. ..... 439/595

[58] Field of Search ..... 439/595, 596, 439/597, 598, 599, 600, 603, 350, 352, 271, 752, 753

[56] References Cited

U.S. PATENT DOCUMENTS

| | | | |
|---|---|---|---|
| 4,544,220 | 10/1985 | Aiello et al. | 439/595 |
| 4,698,030 | 10/1987 | Ryll et al. | 439/752 |
| 4,776,813 | 10/1988 | Wilson et al. | 439/595 |
| 4,826,452 | 5/1989 | Sian et al. | 439/595 |
| 4,944,688 | 7/1990 | Lundergan | 439/275 |
| 4,973,268 | 11/1990 | Smith et al. | 439/595 |
| 4,998,896 | 3/1991 | Lundergan | 439/595 |
| 5,292,261 | 3/1994 | Hirano et al. | 439/595 |

FOREIGN PATENT DOCUMENTS

| | | | |
|---|---|---|---|
| 0160385 | 6/1990 | Japan | 439/595 |

OTHER PUBLICATIONS

AMP Incorporated Publication; *AMP Universal Mate–N–Lok Connectors;* Jan. 10, 1989; p. 1.

*Primary Examiner*—Gary F. Paumen
*Assistant Examiner*—Hien D. Vu

[57] ABSTRACT

A latching mechanism for releasably locking the electrical contacts of an electrical connector in the connector housing is disclosed. Each contact is surrounded by a collet having inwardly extending protrusions that are in depressions formed in the outer surfaces of the contacts. A retaining member is movable to a locked position where it surrounds each of the collets to prevent expansion thereof thereby locking the contacts in place within the housing. The retaining member is also movable to an unlocked position away from the collets, which allows expansion of a collet so that a damaged contact can be removed by simply pulling it out of the housing. A latching mechanism is provided to move the retaining member to its locked and unlocked positions from outside of the connector without disassembly thereof.

17 Claims, 7 Drawing Sheets

ELECTRICAL CONNECTOR WITH TWO STAGE LATCH FOR RETAINING CONTACTS

The present invention relates to electrical connectors and latching mechanisms for retaining the contacts in the connector housing during use, but that are operable for removing the contacts for repair.

BACKGROUND OF THE INVENTION

In the manufacture of electrical connectors various structures have been utilized to retain the contacts in the connector housing during use. Such structures must allow for the insertion of the contact into the connector housing during assembly yet resist forces that tend to pull the contacts out of the housing, for example, when the connector halves are unmated. One of the most common retaining structures is a catch formed on the contact that is forced over a raised portion in the housing, the catch then snaps in place behind the raised portion to prevent removal of the contact. Other structures include a lance that is simply forced into a narrow cavity in the housing to provide a friction fit. A more complex retaining structure that is known in the industry is disclosed in U.S. Pat. Nos. 4,973,268 and 4,944,688 which issued Nov. 27, 1990 and Jul. 31, 1990 respectively. The structure disclosed in these patents utilizes a pair of resilient members formed on a latch member that is secured to the connector housing. Each resilient member has mutually opposing projections that engage depressions formed on opposite sides of the contact. As the contact is pushed into the housing cavity during initial assembly, the contact engages the projections causing the resilient members to deflect outwardly. When the contact is fully seated the projections move into the depressions under the urging of the resilient members. A locking member is then inserted further into the housing to block outward deflection of the resilient members so that the projections are firmly locked in position within the depressions. The locking member includes its own retainer means that secures it to the housing so that when the connector is fully assembled the contacts cannot be removed. If a contact must be repaired the connector must be completely disassembled, which is usually quite difficult to do and occasionally, the retainer means for the locking member is damaged in the process. Another known retaining structure, similar to that just described, utilizes screws to hold the locking member to the connector housing, as shown in FIG. 1. There is shown a connector housing 10, a latch member 12 and a locking member 14. The latch member 12 has a plurality of triplets of resilient members 16 each having a projection 18 that projects inwardly. Each triplet of resilient members 16 is arranged to receive a contact 20 so that the projections 18 engage a groove 22 formed in the contact. When the contacts 20 are in place within the latch member 12 the locking member 14 is assembled to the housing and secured in place by means of the screws 24. The locking member 14 includes portions that extend around each of the triplets of resilient members and block outward deflection so that the projections 18 remain in the groove 22 thereby securing the contacts 20 to the connector. This arrangement permits repair or replacement of damaged contacts, however, the connector must be taken apart and reassembled again. What is needed is a contact retaining mechanism that is operable from outside of the connector to unlock the contacts for removal and repair without disassembling the connector and then to again lock the repaired contacts in position so that the connector can be returned to service.

SUMMARY OF THE INVENTION

An electrical connector is disclosed having a housing and a plurality of contacts in the housing. Each contact has a depression in its outer surface. A catch means is associated with the housing and is operable for engaging and disengaging the depression. A retainer means is provided that is movable in a first direction for holding the catch means in engagement with the depression so that the contacts are retained in the housing and movable in a second direction for permitting the catch means to disengage the depression so that the contacts are removable from the housing. The retainer means is manually moveable in both first and second directions from outside of the connector.

DESCRIPTION OF THE PREFERRED EMBODIMENT

Figure 1:
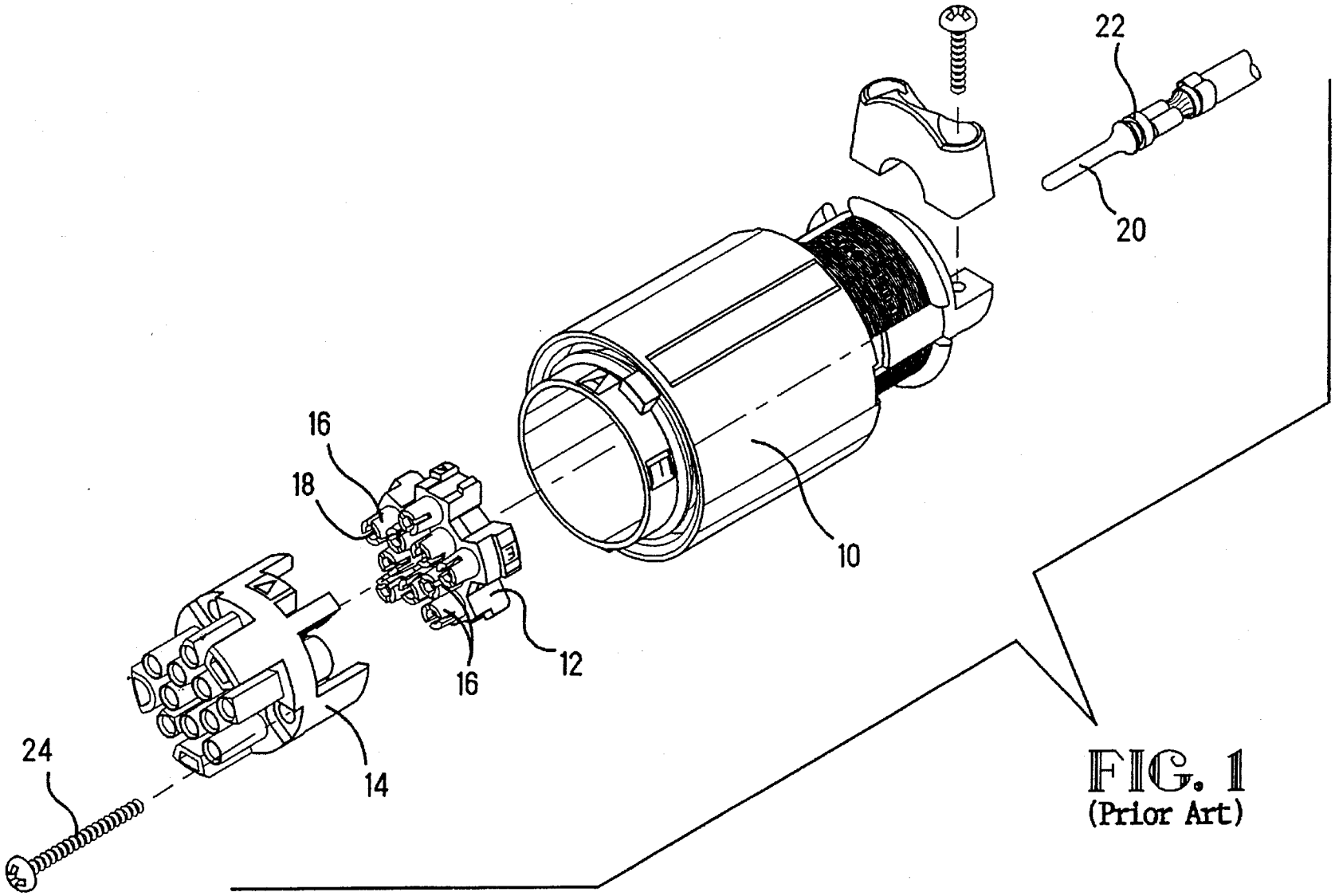
FIG. 1 (Prior Art)
FIG. 1 is an exploded parts view of a prior art electrical connector.
Figure 2:
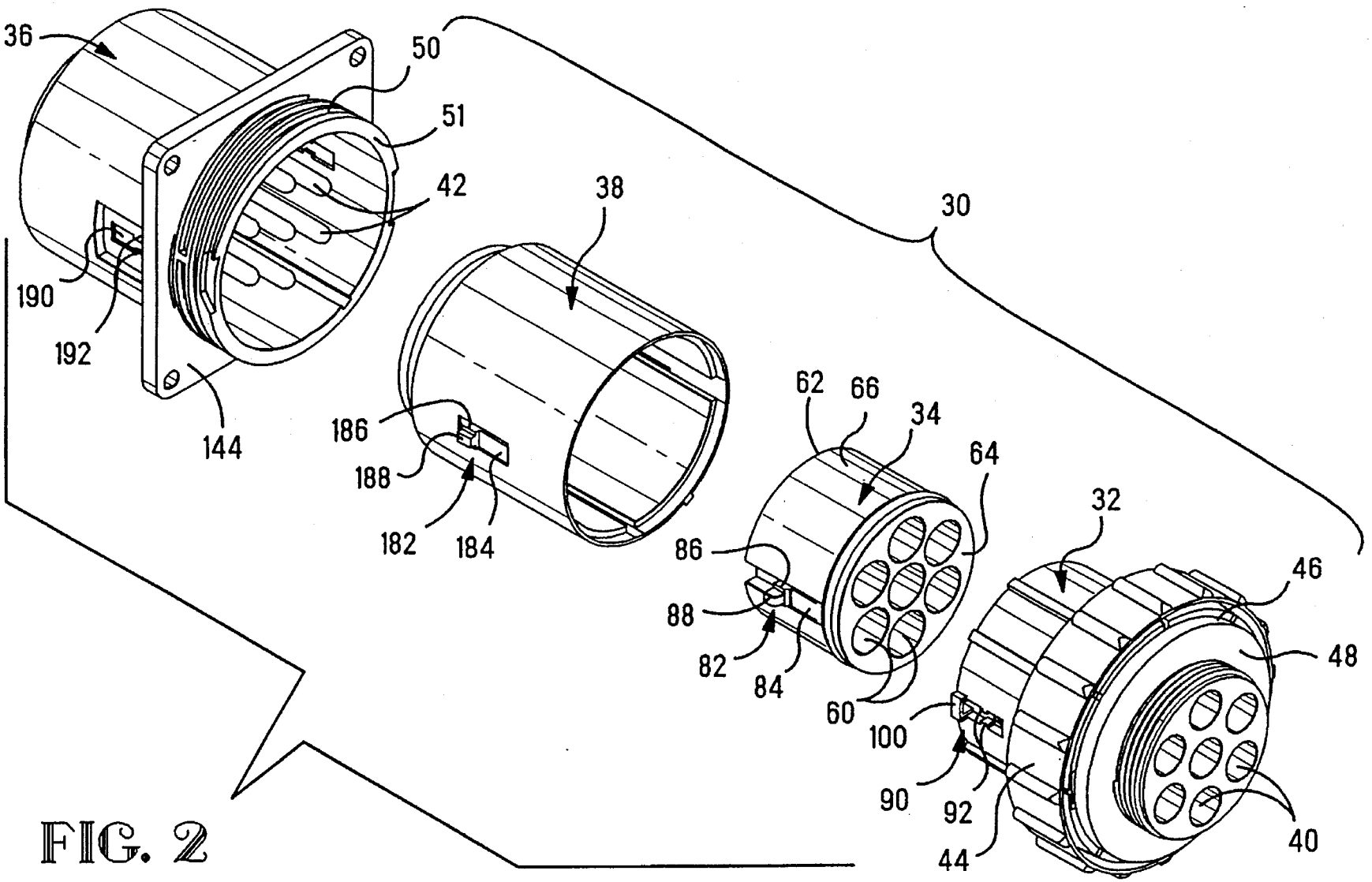
FIG. 2 is an exploded parts view of an electrical connector incorporating the teachings of the present invention.
Figure 4:
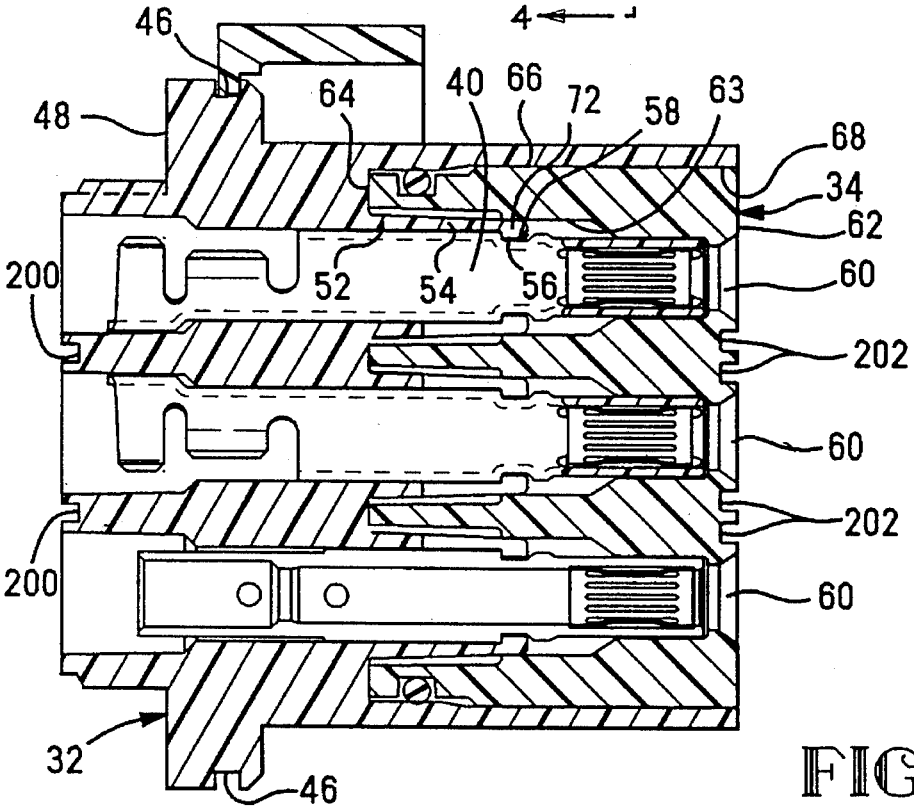
FIG. 4 is a cross-sectional view taken along the lines 4—4 of FIG. 3 showing the locking mechanism in its locked position.
Figure 5:
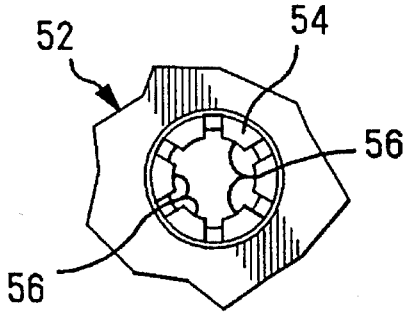
FIG. 5 is a partial end view of one of the collets.

There is shown in FIG. 2 a connector 30 having a plug housing 32, a plug contact retainer 34, a receptacle housing 36, and a receptacle contact retainer 38. The plug housing 32 contains a plurality of socket contacts 40 that receive and mate with a corresponding plurality of pins or contacts 42 contained in the receptacle housing 36. A threaded attachment ring 44 is arranged to rotate within a groove 46 formed in a peripheral flange 48 which is integral with the housing 32, as shown in FIG. 4. The threads of the ring 44 mate with threads 50 formed on an extension 51 of the receptacle housing 36 to lock the plug and receptacle together in mated engagement in the usual manner.

Figure 7:
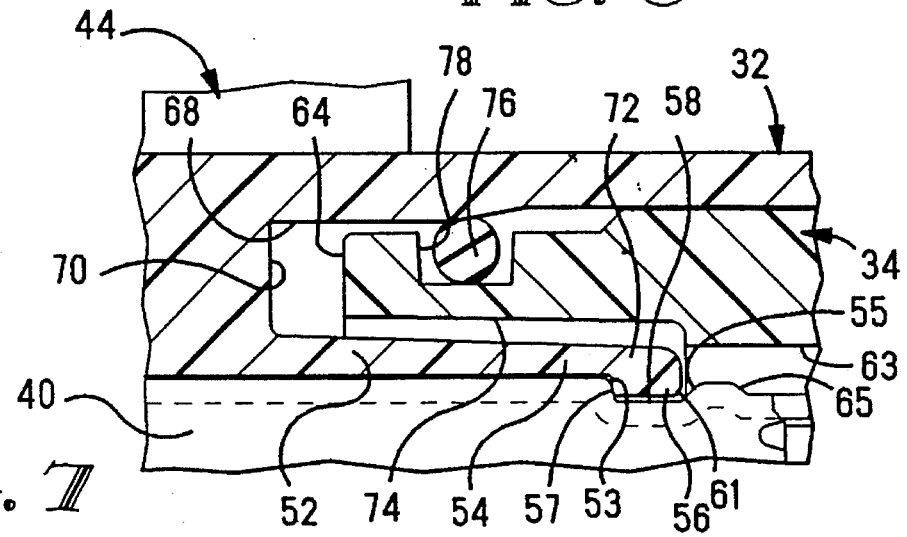
FIG. 7 is a view of a portion of the view of FIG. 6 indicated as A.

As shown in FIGS. 4 and 7 each contact 40 is held within a collet 52, or similar catch means, formed integral with the housing 32. Each collet 52 includes six equally spaced resilient arms 54 that extend outwardly in the direction of the axis of the contact and surrounding it. Each resilient arm 54 includes a projection 56 projecting inwardly toward the contact 40. The contact 40 includes a depression 58 in the form of an annular ring in its outer surface. When the contacts 40 are fully seated within the plug housing 32, as shown in FIG. 4, the projections 56 are in the depression 58. As best seen in FIG. 7, the depression 58 includes a vertical or nearly vertical wall 53 and a surface 55 which is inclined to the centerline of the contact by about 45 degrees. The projection 56 includes a vertical wall 57 opposing the wall 53 and a radius 61 opposite the surface 55. The contact 40 may be removed from the plug housing 32 by simply pulling it leftwardly along its axis, as viewed in FIG. 4, so that the radius 61 cams the projection 56 up the surface 55 and out of the depression 58 and along the outer surface of the contact. When a contact 40 is inserted into the plug housing the projection 56 engages and rides up on an angled surface 65 of the contact until the projection 56 snaps into the depression 58. The wall 57 of the projection 56 then abuts the wall 53 of the contact thereby preventing further insertion thereof.

Figure 6:
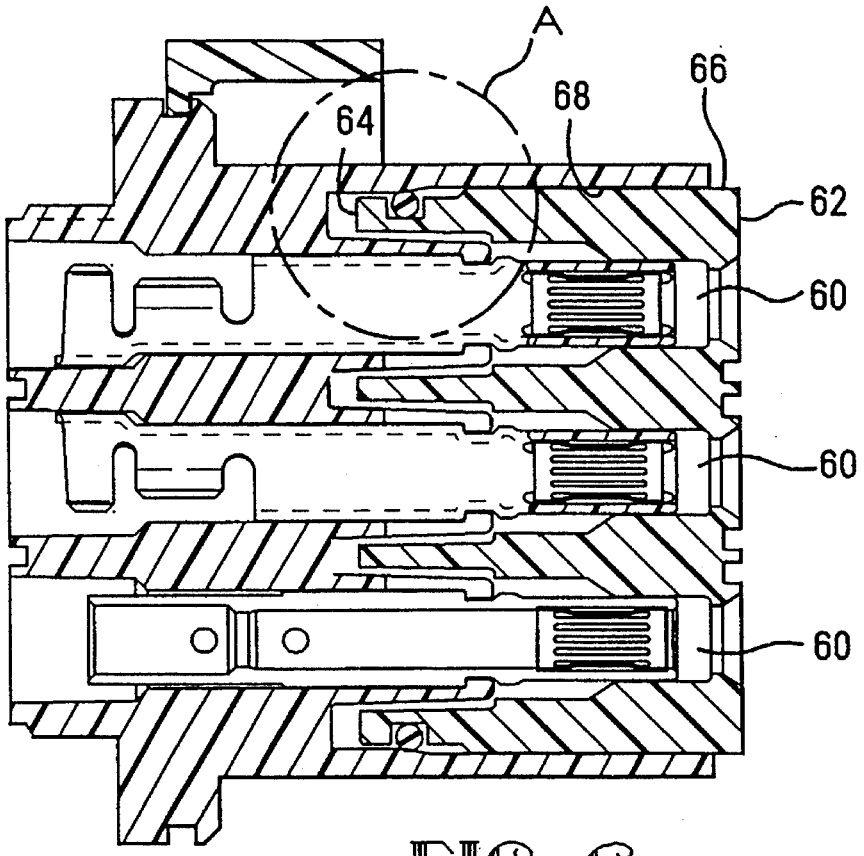
FIG. 6 is a cross-sectional view similar to FIG. 4 showing the locking mechanism in its unlocked position.

The plug contact retainer 34 includes a plurality of openings 60 in alignment with the sockets 40, as shown in FIGS. 2 and 4, each opening being sized at one end 62 to loosely receive the mating ends of the sockets 40 and provided with a bore 63 at the other end 64 to slip over the collet 52 with little or no clearance, as best seen in FIG. 7. The outer diameter 66 of the contact retainer is sized to be a slip fit with the inside diameter 68 of the plug housing 32 so that the contact retainer is free to slide into and out of the plug housing. The diameter 68 terminates in a floor 70 within the plug housing 32. The contact retainer 34 can slide into the plug housing 32 until it is adjacent the floor 70. This is its closed and locked position. When in this position, as shown in FIG. 4, the walls of the bores 63 form extensions that encircle the ends 72 of the arms 54 preventing them from moving outwardly thereby holding the projections 56 within the depression 58 and locking the contacts 40 within the plug housing. Each opening 60 at the end 64 has a counterbore 74 that extends to a depth that is less than the length of the collet 52. The plug contact retainer 34 can be moved away from the floor 70 to its open and unlocked position, as shown in FIGS. 6 and 7. In this position the counterbores 74 now extend past the ends 72 of the arms 54 so that the contacts 40 can be moved toward the left along their axes, as viewed in FIG. 6. Such movement will cause the projections 56 to cam up and out of the depressions 58, the arms 54 deflecting into the space provided by the counterbores 74. An O-ring 76 is arranged in a groove 78 so that the O-ring seals against the inside diameter 68 of the plug housing 32.

Figure 8:
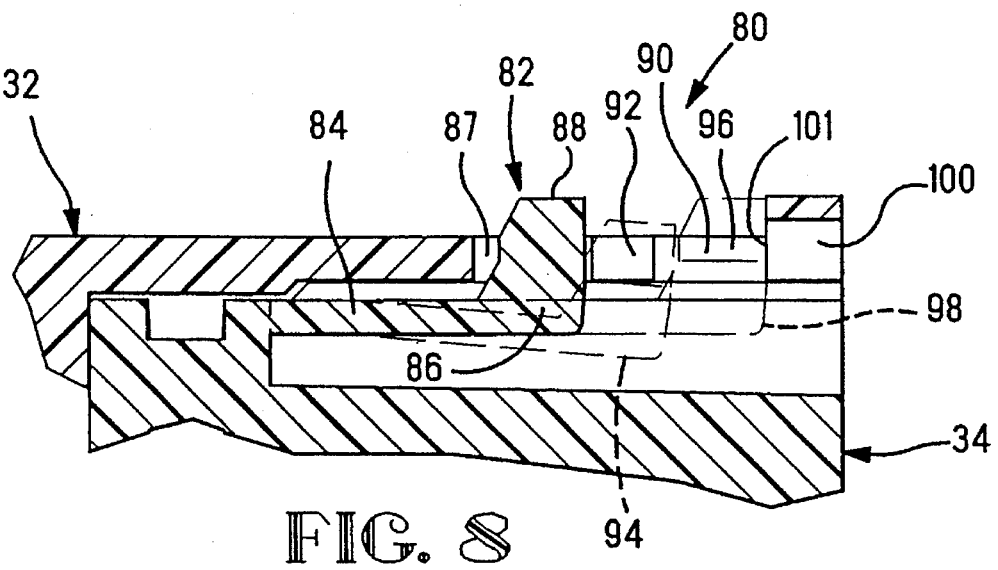
FIG. 8 is a partial cross-sectional view of the actuating mechanism for locking and unlocking the plug contacts.

The movement of the plug contact retainer 34 between its open and closed positions is controlled by a pair of latch mechanisms 80, as best seen in FIG. 8, that are spaced 180 degrees apart, in the present example. Each of the latch mechanism includes a latch lever 82 having a resilient portion 84 attached at one end thereof to the plug contact retainer 34 and at the other end thereof to a shank 86. A handle 88, narrower than the shank, projects outwardly from the shank through an opening 90 formed in the plug housing 32. There are two such openings spaced diametrically opposite to accommodate the two latch mechanisms 80. There are a pair of opposing protrusions 92 within the opening 90, about midway along the length thereof, that are spaced apart just enough to permit passage of the handle 88 therebetween but not the shank 86. The shank 86, however, will fit within the opening 90 at either end thereof. As shown in FIG. 8, the shank 86 is positioned within the left most end 87 of the opening 90 with the handle 88 extending slightly above the outer surface of the plug housing 32. In this position the resilient member 84 holds the shank 86 within the opening 90 and the protrusions 92 hold the shank 86 in the end 87. By depressing the handle 88 of each latching mechanism so that it is about flush with the surface of the housing 32, as shown in phantom lines at 94 in FIG. 8, the shank 86 will clear below the protrusions 92 as the plug contact retainer 34 is moved to its open position, as shown in FIG. 6. In this position the resilient member 84 will urge the shank 86 into the other end 96 of the opening 90 as shown in phantom lines at 98 in FIG. 8. A groove 100 is formed in the surface of the diameter 68 from the opening 90 to the end 34 of the plug housing and forms a shoulder 101 that serves as a stop for the latch mechanism yet will allow the depressed handle 80 to pass therethrough when assembling the parts. By moving the latch lever handle 88 to the end 96 of the opening, the plug contact retainer 34 is moved to its open and unlocked position so that the contacts 40 are free to be removed and replaced. By moving the latch lever handle 88 to the end 87, the plug contact retainer 34 is moved to its closed and locked position so that the contacts 40 are secured in position for use.

Figure 9:
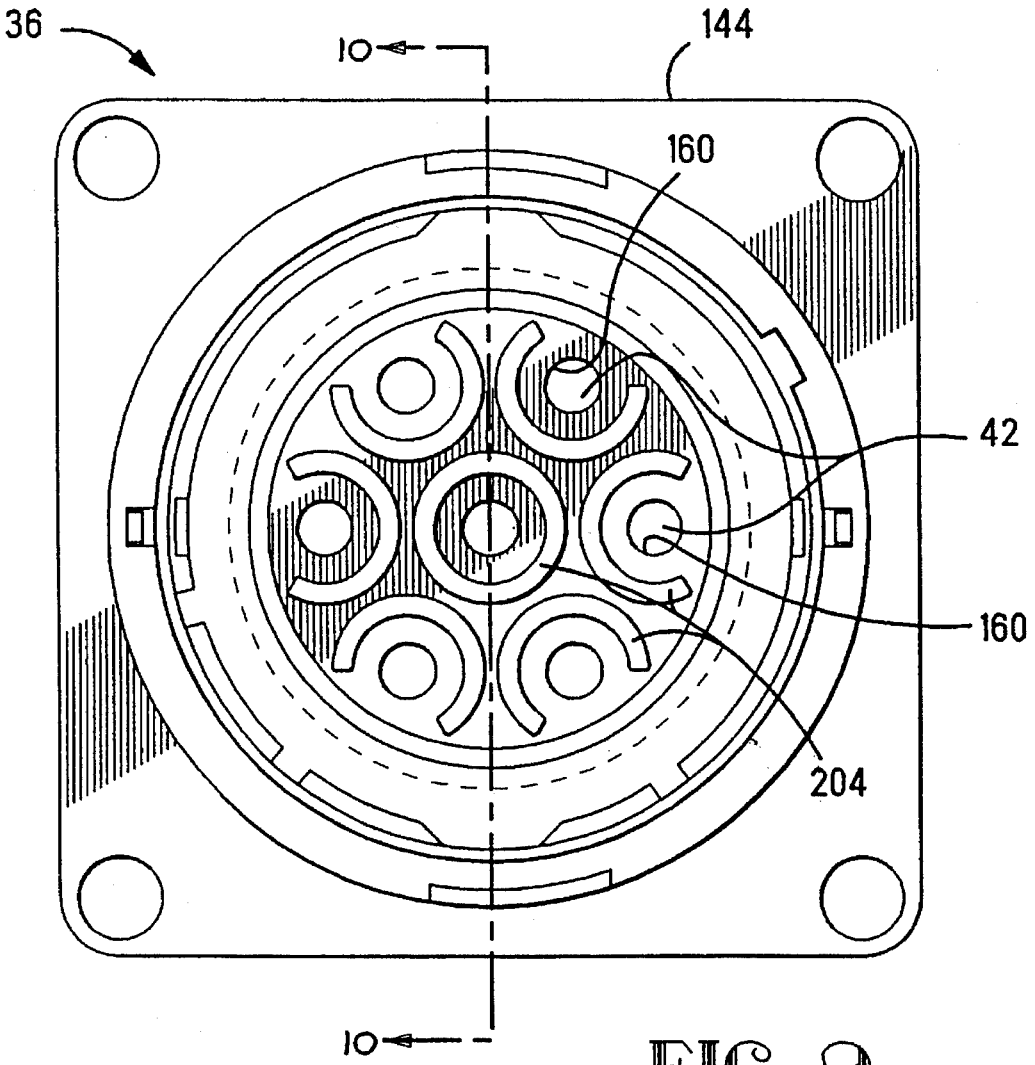
FIG. 9 is an end view of the receptacle shown in FIG. 2.
Figure 10:
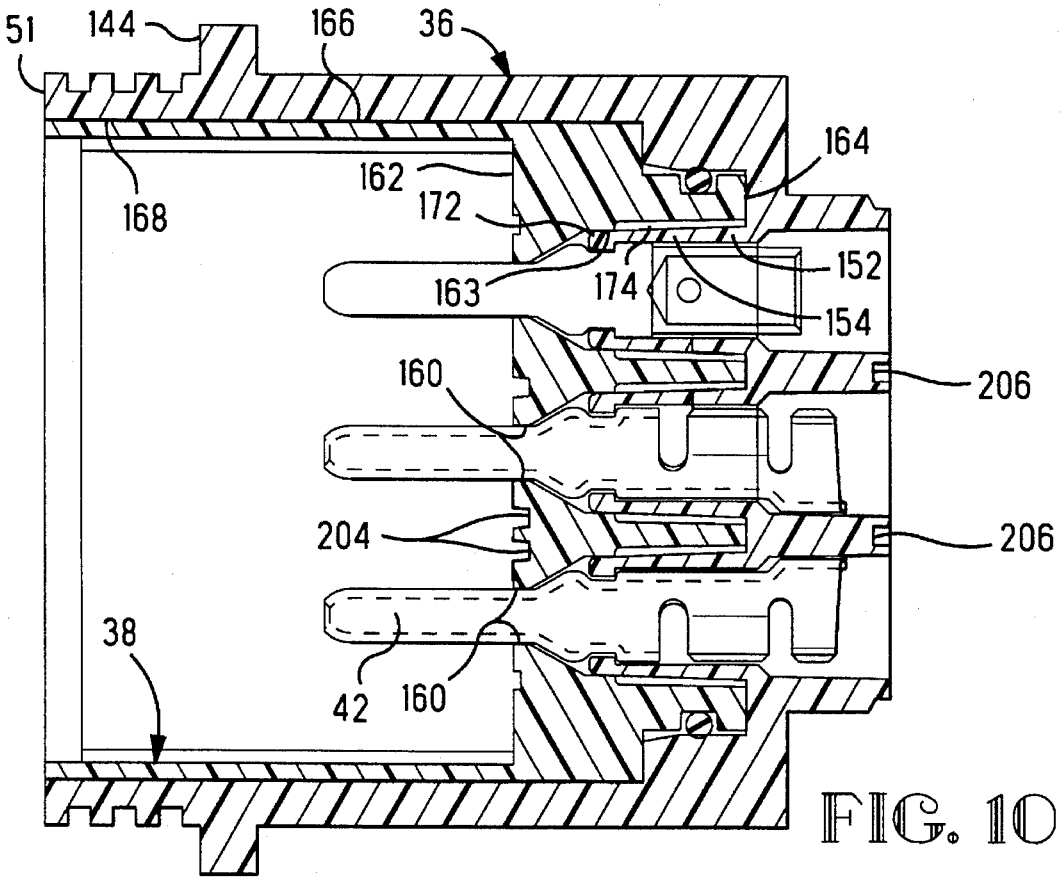
FIG. 10 is a cross-sectional view taken along the lines 10—10 of FIG. 9 showing the locking mechanism in its locked position.

As shown in FIGS. 9 through 12, the receptacle housing 36 and receptacle contact retainer 38 function in a manner similar to that of the plug housing and plug contact retainer. The receptacle housing 36 contains a plurality of pin contacts 42 that mate with the socket contacts 40 contained in the plug housing 36. As shown in FIGS. 9 and 10 the receptacle housing 36 includes a mounting flange 144 for mounting to a panel. As shown in FIGS. 10 and 13 each contact 42 is held within a collet 152 formed integral with the housing 36. Each collet 152 includes six equally spaced resilient arms 154 that extend outwardly in the direction of the axis of the contact and completely surrounding it. Each resilient arm 154 includes a projection 156 projecting inwardly toward the contact 42. The contact 42 includes a depression 158 in the form of an annular ring in its outer surface. When the contacts 42 are fully seated within the receptacle housing 36, as shown in FIG. 10, the projections 156 are in the depression 158. The projections 156 and the depressions 158 are similar to the projections 56 and the depressions 58 shown in FIG. 7 and include vertical or near vertical walls 157 and 153 respectively and a radius 161 and inclined surface 155 respectively. The contact 42 may be removed from the receptacle housing 36 by simply pulling it rightwardly along its axis, as viewed in FIG. 10, so that the projection 156 cams outwardly out of the depression 158 and slides along the outer surface of the contact in a manner similar to that of the contact 40. Additionally, when inserting the contact, the wall 157 of the projection 156 and the opposing wall 153 of the contact limit the depth of insertion.

Figure 11:
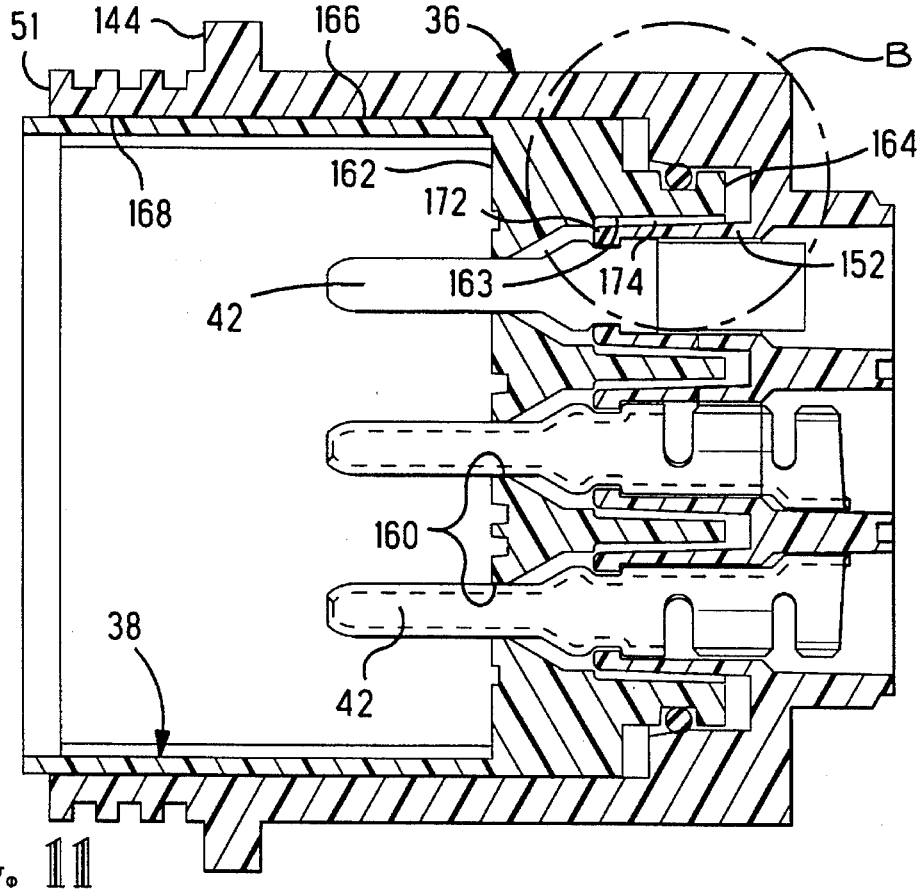
FIG. 11 is a cross-sectional view similar to FIG. 10 showing the locking mechanism in its unlocked position.

The receptacle contact retainer 38, as shown in FIG. 9 and 10, includes a plurality of openings 160 in alignment with the pins 42, each opening being sized at one end 162 to loosely receive the mating ends of the pins 42 and provided with a bore 163 at the other end 64 to slip over the collet 152 with little or no clearance, as best seen in FIG. 13. The outer diameter 166 of the contact retainer is sized to be a slip fit with the inside diameter 168 of the receptacle housing 36 so that the contact retainer is free to slide into and out of the receptacle housing. The diameter 68 terminates in a floor 170 within the receptacle housing 36. The contact retainer 38 can slide into the receptacle housing 36 until it is adjacent the floor 70. This is its closed and locked position. When in this position, as shown in FIG. 10, the walls of the bores 163 encircle the ends 172 of the arms 154 preventing them from moving outwardly thereby holding the projections 156 within the depression 158 and locking the contacts 42 within the receptacle housing. Each opening 160 at the end 164 has a counterbore 174 that extends to a depth that is less than the length of the collet 152. The receptacle contact retainer 38 can be move away from the floor 170 to its open and unlocked position, as shown in FIGS. 11 and 13. In this position the counterbores 174 now extend past the ends 172 of the arms 154 so that the contacts 42 can be moved toward the right along their axes, as viewed in Figure 11. Such movement will cause the projections 156 to cam up and out of the depressions 158, the arms 154 deflecting into the space provided by the counterbores 174. An O-ring 176 is arranged in a groove 178 so that the O-ring seals against an inside diameter 169 of the receptacle housing 36.

Figure 12:
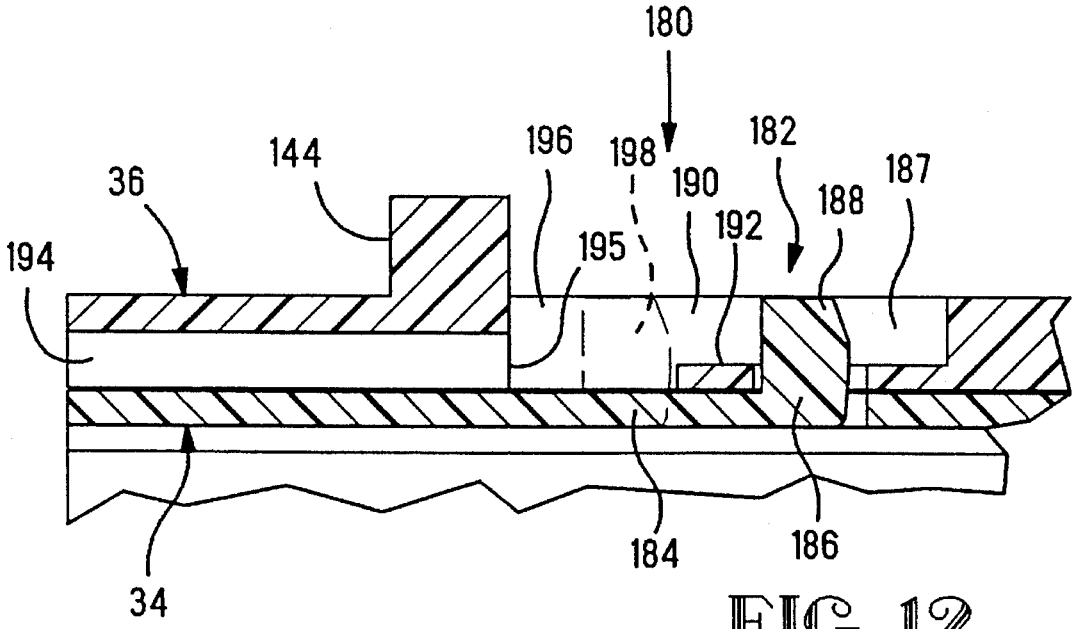
FIG. 12 is a partial cross-sectional view of the actuating mechanism for locking and unlocking the receptacle contacts.
Figure 13:
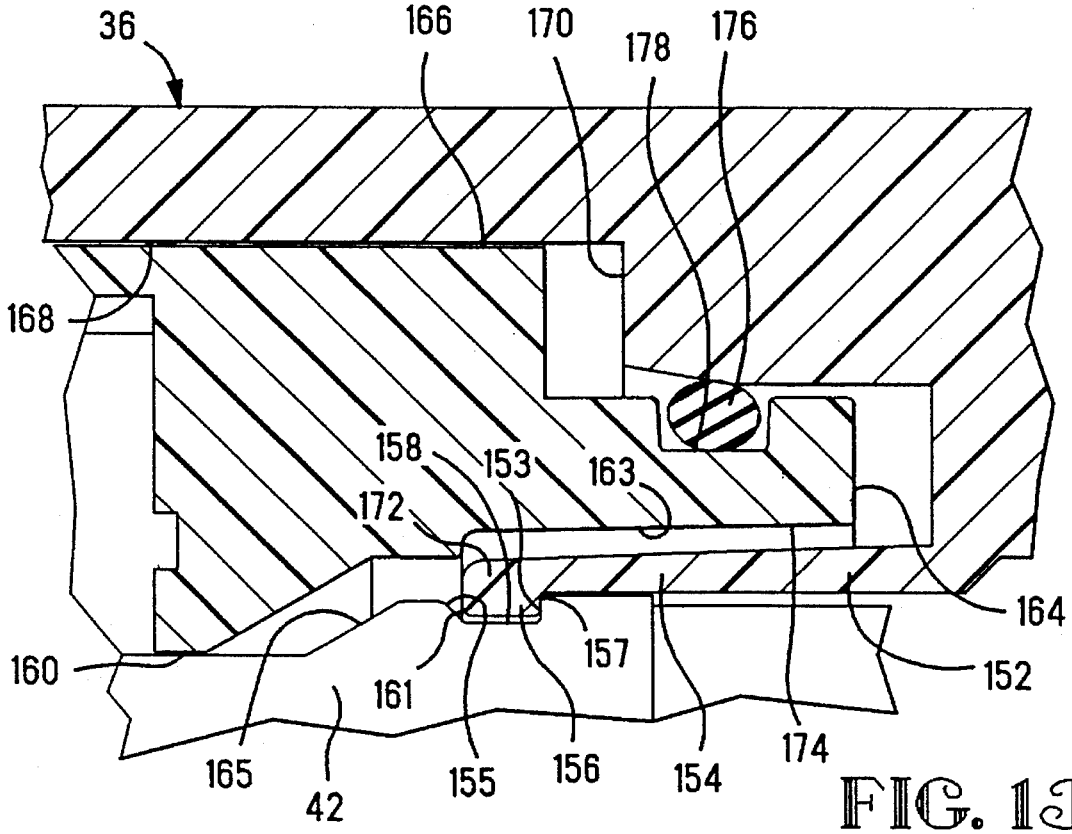
FIG. 13 is a view of a portion of the view of FIG. 11 indicated as B.

The movement of the receptacle contact retainer 38 between its open and closed positions is controlled by a pair of latch mechanisms 180, as best seen in FIG. 12, that are spaced 180 degrees apart. Each of the latch mechanism includes a latch lever 182 having a resilient portion 184 attached at one end thereof to the receptacle contact retainer 38 and at the other end thereof to a shank 186. A handle 188, narrower than the shank, projects outwardly from the shank through an opening 190 formed in the receptacle housing 36. There are two such openings spaced diametrically opposite to accommodate the two latch mechanisms 180. Note that the opening 190 and latch lever 182 are recessed below the outer surface of the receptacle housing 36. This is for providing manual access to the handle 188 while keeping the outer profile of the receptacle obstruction free. There are a pair of opposing protrusions 192 within the opening 190, about midway along the length thereof, that are spaced apart just enough to permit passage of the handle 188 therebetween but not the shank 186. The shank 186, however, will fit within the opening 190 at either end thereof. As shown in FIG. 12, the shank 186 is positioned within the right most end 187 of the opening 190 with the handle 188 extending above the outer surface of the protrusions 192. In this position the resilient member 184 holds the shank within the opening 190 and the protrusions 192 hold the shank in the end 187. By depressing the handle 188 of each latching mechanism so that it is about flush with the surface of the protrusions 192 the shank 186 will clear below the protrusions 192 as the receptacle contact retainer 38 is moved to its open position, as shown in FIG. 11. In this position the resilient member 184 will urge the shank 186 into the other end 196 of the opening 190 as shown in phantom lines at 198 in FIG. 12. A groove 194 is formed in the surface of the inside diameter 168 from the opening 190 to the end of the receptacle housing and forms a shoulder that serves as a stop for the latch mechanism, yet will allow the depressed handle to pass thereunder when assembling the parts. By moving the latch lever handle 188 to the end 196 of the opening, the receptacle contact retainer 38 is moved to its open and unlocked position so that the contacts 42 are free to be removed and replaced. By moving the latch lever handle 188 to the end 187, the receptacle contact retainer 38 is moved to its closed and locked position so that the contacts 42 are secured in position for use.

Figure 3:
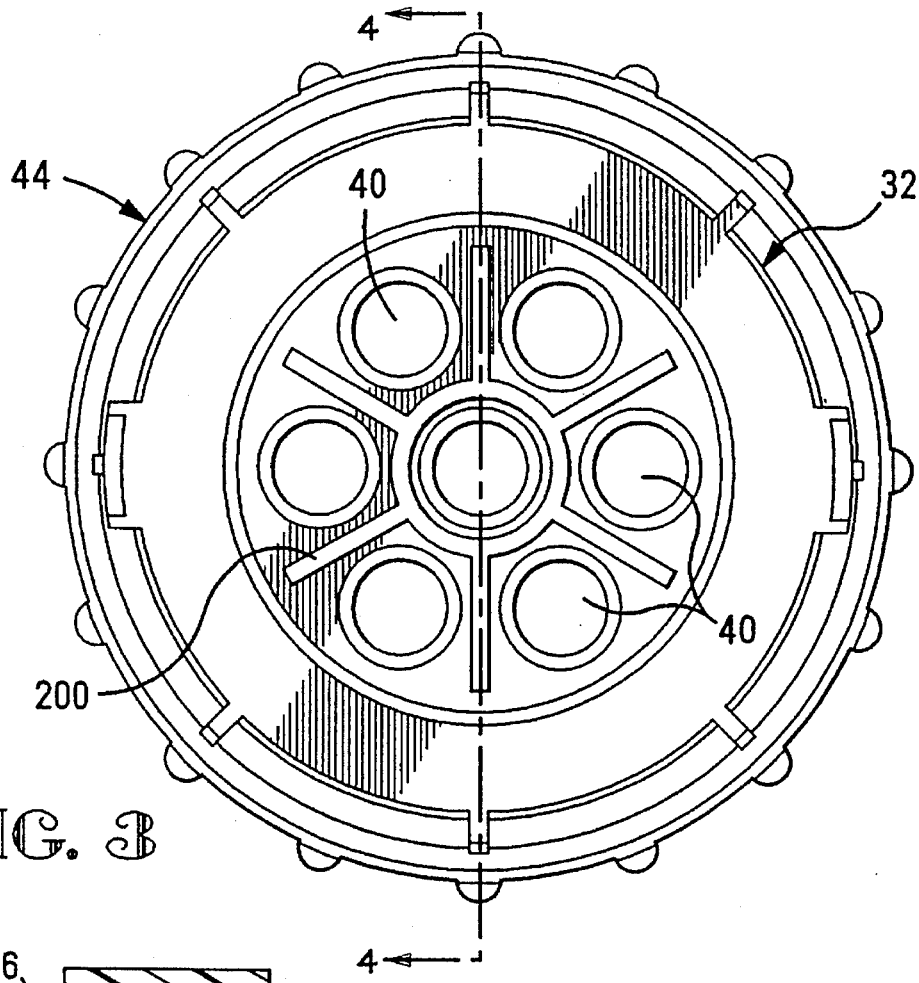
FIG. 3 is an end view of the plug shown in FIG. 2.

The connector 30 may be used in relatively high voltage applications, therefore, the minimum distance between adjacent contacts or between a contact and any other adjacent conductive surface measured along the surface of the insulating housing becomes important. This minimum distance is known in the industry as "creep distance". By increasing the creep distance the voltage carrying capacity of the connector is also increased. The plug housing 32 includes a well structure 200 formed about the openings for the sockets 40 that is recessed into the surface of the housing as shown in FIGS. 3 and 4. Another well structure 202 is formed in the surface in the end 62 of the contact retainer 34. These wells 200 and 202 as well as the walls of the collets 52 and the floor 70 effectively increases the creep distance between the sockets 40. Similarly, the receptacle housing 36 includes a well structure 204 between the openings for the pins 42 and another well structure 206 in the surface of the contact retainer 38. These wells and the walls of the collets 152 effectively increase the creep distance between the pins 42.

In the present example, the entire connector, except the contacts, is made of plastic, including the receptacle and plug housings, the plug coupling ring, and the two contact retainers, however, any suitable material may be used. It will be understood that, while the depressions 58 and 158 are annular grooves in the outer surface of the contacts, discrete depressions that are in alignment with the protrusions 56 and 156 respectively would be suitable in the practice of the present invention. For purposes of this disclosure, the term "depression", as used herein, shall be considered to include holes or other openings in the surface of the contact as well as recessed areas. While collets are utilized as catch means in the present example, other suitable catch means may be used to engage and disengage the depressions in the contacts. Further, the present collets 52 and 152 show six spaced arms, however, fewer or more arms may be advantageous in certain applications and are considered within the scope of the present invention.

An important advantage of the present invention is that the unique contact retaining mechanism is manually operable from outside of the connector. There is no need to disassemble the connector nor is there need for tools of any kind. This aids in the relatively quick and inexpensive repair of damaged contacts in the field. Additionally, the unique structure of the depression in the surface of the contacts and the mating protrusions of the collets prevent over insertion of the contacts into their housings.

We claim:

1. An electrical connector comprising:

(a) a housing;

(b) a plurality of contacts insertable in a first direction into said housing, each contact having a depression in its surface, said depression having an inclined surface;

(c) catch means associated with said housing and operable for engaging said depression to block axial movement of each of said plurality of contacts in said first direction and cooperative with said inclined surface when said each contact is moved axially in a second direction opposite said first direction away from said housing so that said catch means engages said inclined surface and is cammed out of said engagement with said depression;

(d) retainer means movable in said second direction for holding said catch means in said engagement with said depressions so that said contacts are retained in said housing and movable in said first direction for permitting said catch means to disengage said depressions so that said contacts are removable from said housing, wherein said retainer means is manually moveable in said first and second directions from outside said connector, (e) a latch coupled to said retainer means and extending through an opening in said housing so that when said latch is adjacent a first said end of said opening said retainer means is holding said catch means in said engagement with said depressions and when said latch is adjacent a second closed end of said opening said retainer means will permit said catch means to disengage said depressions, said latch includes a handle that projects through said opening, a shank, and resilient means for urging said shank toward said opening so that said shank interacts with a feature of said housing to retain said latch adjacent both said first and second ends.

2. An electrical connector comprising:

(a) a housing;

(b) a plurality of contacts insertable in a first direction into said housing, each contact having a depression in its surface;

(c) catch means associated with said housing and operable for engaging said depressions to block axial movement of said contacts in said first direction and for disengaging said depressions to allow said axial movement of said contacts in a second direction opposite said first direction;

(d) retainer means movable in said second direction for holding said catch means in said engagement with said depressions so that said contacts are retained in said housing and movable in said first direction for permitting said catch means to disengage said depressions so that said contacts are removable from said housing, wherein said retainer means is manually moveable in said first and second directions from outside said connector by means of a latch lever means, said housing includes a plurality of openings, each opening containing a respective said contact and a first counterbore having a floor and wherein said catch means extends from said floor, wherein said catch means includes a plurality of resilient arms extending from said floor and terminating in inwardly extending protrusions so that said protrusions are in said engagement with said depressions, and wherein said retainer means includes a plurality of extensions, each extension surrounding a respective one catch means so that when moved in said first direction said retainer means abuts said floor and said extension holds said protrusions in said engagement with said depression.

3. The connector according to claim 2 wherein each said extension includes a second counterbore arranged so that when said retainer means is moved in said second direction away from said floor said catch means is free to expand into said second counterbore so that said protrusions can disengage said depression thereby permitting axial movement of said contacts.

4. An electrical connector comprising:

a housing to receive electrical contacts, moveable catches in the housing being moveable by engagement with wide portions of the electrical contacts passing the moveable catches during insertion of the electrical contacts in a first direction into the housing and during withdrawal of the electrical contacts in a second direction opposite said first direction out of the housing, the catches being moveable in reverse to be latched against the electrical contacts, a contact retainer overlapping the moveable catches, the contact retainer in a first position being latched to the housing, and being spaced from the catches thereby defining a space within which the catches move when engaged by the wide portions of the electrical contacts during said withdrawal of the electrical contacts in said second direction, the contact retainer being moveable from said first position to a second position thereby narrowing the space to prevent movement of the catches away from being latched against the electrical contacts, and a handle on the contact retainer being confined within a groove in the housing, the groove having closed ends, and the handle protruding from the groove and being moveable along the groove for moving the retainer between said first and second positions while the contact retainer remains latched to the housing.

5. A connector as recited in claim 4 wherein, the handle is at one closed end when the contact retainer is in said first position, and the handle is at a second closed end when the contact retainer is in said second position.

6. A connector as recited in claim 4 wherein, the handle is on a resilient latch lever, and the groove has wide portions receiving the latch lever, the groove has a narrower portion connecting the wide portions, the latch lever is wider than the narrower portion of the groove, the handle depresses the latch lever resiliently to move the latch lever out of receipt with one of the wide portions of the groove, and the handle depresses the latch lever resiliently during movement of the latch lever past the narrower portion of the groove.

7. A connector as recited in claim 4 wherein, the handle protrudes through an exterior of the housing to be moveable from outside the housing.

8. A connector as recited in claim 4, and further comprising: an electrical contact having a depression next to an angled surface on a wide portion of the contact, the contact being received in the housing, the depression receiving at least one of the moveable catches, and the contact being removable from the housing by movement of the angled surface past said one of the moveable catches and moving said one of the moveable catches away, with said contact retainer being in said first position.

9. An electrical connector as recited in claim 8, and further comprising: a shoulder on each of the contacts facing the housing and limiting insertion of the contacts in the housing.

10. An electrical connector comprising:

a housing having a first end to receive the electrical contacts, the housing having a second end to receive a contact retainer, electrical contacts inserted in a first direction into the first end of the housing, wide portions on the electrical contacts, movable catches in the housing being movable by engagement with the wide portions of the electrical contacts passing the movable catches during said insertion of the electrical contacts into the housing and during withdrawal of the electrical contacts in a second direction opposite said first direction out of the housing, the catches being movable in reverse to be latched against the electrical contacts received in the housing, and the contact retainer received in a second end of the housing, the contact retainer in a first position being latched to the housing, and being spaced from the catches thereby defining a space within which the catches move when engaged by the wide portions of the electrical contacts during said withdrawal of the electrical contacts in said second direction, and the contact retainer being movable from said first position to a second position the narrowing the space to prevent movement of the catches away from being latched against the electrical contacts.

11. An electrical connector as recited in claim 10, and further comprising: a shoulder on each of the contacts facing the housing and limiting insertion of the contacts in the housing.

12. A connector as recited in claim 10, and further comprising: a depression next to an angled surface on a wide portion on each of the electrical contacts, the depression receiving at least one of the moveable catches, and each of the electrical contacts being removable from the housing by movement of the angled surface past said one of the moveable catches and moving said one of the moveable catches away, with said contact retainer being in said first position.

13. An electrical connector as recited in claim 10, and further comprising: a handle on the contact retainer being confined within a groove in the housing, the groove having closed ends, and the handle protruding from the groove and being moveable along the groove while retaining the contact retainer inseparably with the housing and while moving the contact retainer between said first and second positions.

14. A connector as recited in claim 13 wherein, the handle is at one closed end when the contact retainer is in said first position, and the handle is at a second closed end when the contact retainer is in said second position.

15. A connector as recited in claim 13 wherein, the handle is on a resilient latch lever, and the groove has wide portions receiving the latch lever, the groove has a narrower portion connecting the wide portions, the latch lever is wider than the narrower portion of the groove, the handle depresses the latch lever resiliently to move the latch lever out of receipt with one of the wide portions of the groove, and the handle depresses the latch lever resiliently during movement of the latch lever past the narrower portion of the groove.

16. A connector as recited in claim 13 wherein, the handle protrudes through an exterior of the housing to be moveable from outside the housing.

17. An electrical connector comprising:

(a) a housing;

(b) a plurality of contacts insertable in a first direction into said housing, each contact having a depression in its surface, said depression having an inclined surface;

(c) catch means associated with said housing and operable for engaging said depressions to block axial movement of said contacts in said first direction and cooperative with said inclined surfaces when said contacts are moved axially in a second direction opposite said first direction away from said housing so that said catch means engage said inclined surfaces and are cammed out of said engagement with said depressions;

(d) retainer means movable in said second direction for holding said catch means in said engagement with said depressions so that said contacts are retained in said housing and movable in said first direction for permitting said catch means to disengage said depressions so that said contacts are removable from said housing, wherein said retainer means is manually moveable in said first and second directions from outside said connector by means of a latch lever means.

* * * * *